US005402216A

United States Patent [19]

Komaki et al.

[11] Patent Number: 5,402,216

[45] Date of Patent: Mar. 28, 1995

[54] MECHANISM FOR OPENING/CLOSING A TONER FALLING APERTURE

[75] Inventors: Susumu Komaki; Shuji Fujisawa, both of Osaka, Japan

[73] Assignee: Mita Industrial Co., Ltd., Osaka, Japan

[21] Appl. No.: 166,948

[22] Filed: Dec. 15, 1993

[30] Foreign Application Priority Data

Dec. 28, 1992 [JP] Japan ..... 4-348246
Jan. 11, 1993 [JP] Japan ..... 5-002745

[51] Int. Cl.[6] ..... G03G 15/06

[52] U.S. Cl. ..... 355/260; 141/346; 141/351; 141/383; 222/DIG. 1

[58] Field of Search ..... 355/246, 245, 260, 298; 118/653; 222/DIG. 1, 236, 238, 541, 162; 156/344, 247, 584; 242/55.3, 71.1; 141/326, 330, 346, 348, 349, 350, 351, 352, 383, 386

[56] References Cited

U.S. PATENT DOCUMENTS 4,849,791 7/1989 Hagihara et al. ..... 355/260 X
4,942,432 7/1990 Mort et al. ..... 355/260
5,089,854 2/1992 Kaieda et al. ..... 355/260
5,091,750 2/1992 Yoshida et al. ..... 355/260
5,132,740 7/1992 Okamoto et al. ..... 355/298
5,142,335 8/1992 Sakata et al. ..... 222/DIG. 1 X
5,235,390 8/1993 Ishikawa ..... 222/DIG. 1 X
5,264,901 11/1993 Rossiter ..... 355/260
5,294,963 3/1994 Nakano et al. ..... 355/260

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

A mechanism for opening/closing a toner falling aperture is adapted to open/close a toner falling aperture formed in the bottom of a toner cartridge main body in which toner is housed. Disposed inside of the toner cartridge main body is a screw conveyor for conveying the toner to the toner falling aperture. While the toner cartridge is not under use, an elastic sealing member attached to the top surface of the bottom of the toner cartridge main body, closes the toner falling aperture. One end of the sealing member is secured to the screw conveyor. When the toner cartridge is set to a predetermined portion of the main body of an image forming apparatus and the screw conveyor is driven, the screw conveyor takes up the sealing member while winding the same thereon, thus opening the toner falling aperture. The sealing member to which toner is sticked, is taken up by the screw conveyor and held inside of the toner cartridge main body.

14 Claims, 16 Drawing Sheets

MECHANISM FOR OPENING/CLOSING A TONER FALLING APERTURE

CROSS REFERENCE TO RELATED APPLICATION

This Application claims priority benifit under 35 USC section 119 of Japanese Patent Application Serial No. 4-3482415, filed on Dec. 28, 1992 and No. 5-2745, filed on Jan. 11, 1993, the disclosures of which are incorporated by reference.

BACKGROUND OF THE INVENTION

The present invention relates to a mechanism for opening/closing a toner falling aperture through which toner is supplied from a toner cartridge to the developing device in an image forming apparatus such as an electrostatic copying apparatus, a facsimile, a laser beam printer or the like.

In the image forming apparatus above-mentioned, a toner cartridge is removably attached to a housing concave in the main body of the image forming apparatus. A toner cartridge of which toner has been used up, is to be replaced with a new toner cartridge.

Generally, a toner cartridge has a sealing member made of an elastic sheet which removably covers, at the outer surface of the main body of the toner cartridge, a toner falling aperture formed in the bottom of the toner cartridge main body in which toner is housed. After the toner cartridge has been set to the housing concave, the sealing member is torn off, causing the toner falling aperture to be opened. Then, toner falling through the toner falling aperture, is supplied to the developing device which is disposed under the toner falling aperture. The sealing member thus torn off, is separated from the toner cartridge and taken out to the outside of the main body of the image forming apparatus. This disadvantagesouly presents the problem that the toner stuck to the sealing member scatters inside and outside of the main body of the image forming apparatus.

On the other hand, there is proposed an image forming apparatus having an opening/closing mechanism for opening/closing a toner falling aperture formed in the bottom of the main body of a toner cartridge. Further, the developing device may be made in the form of a unit and adapted to be inserted in and removed from a housing concave of the main body of an image forming apparatus. In this connection, there is proposed an image forming apparatus having an opening/closing mechanism for opening/closing a toner falling aperture formed in the top surface of the developing unit.

Conventionally, the opening/closing mechanism of the developing unit is operated irrespectively of the operation of the opening/closing mechanism of the toner cartridge. This produces a difference in toner falling aperture opening/closing timing between the opening/closing mechanisms. This may cause toner to fall in the space between the opposite surfaces of the developing unit and the toner cartridge (between the top surface of the developing unit and the underside of the toner cartridge). This involves the likelihood that the falling toner scatters at the time when the toner cartridge is pulled out.

SUMMARY OF THE INVENTION

In view of the foregoing, the present invention is proposed with the object of providing an economical mechanism for opening/closing a toner falling aperture, which prevents toner from scattering.

To achieve the object above-mentioned, the present invention provides, as a first aspect, a mechanism for opening/closing a toner falling aperture formed in the bottom of the main body of a toner cartridge in which toner is housed, comprising: an elastic sealing member which is disposed inside of the toner cartridge main body and which is removably attached to the top surface of the bottom for closing the toner falling aperture; and taking-off means which is disposed inside of the toner cartridge main body, to which an end of the sealing member is secured, and which is adapted to take off the sealing member while winding the same thereon when the taking-off means is driven by o an external driving source.

According to the arrangement above-mentioned, the toner cartridge which has not been used yet, is mounted on the main body of an image forming apparatus, and the taking-off means is then driven by the external drive source, so that the sealing member is wound on the taking-off means, causing the sealing member to be stripped off from the bottom of the toner cartridge main body. This causes the toner falling aperture to be opened. The sealing member to which toner is stuck, is taken up by the taking-off means and held inside of the toner cartridge main body. This prevents toner from scattering outside of the toner cartridge when the toner cartridge is replaced.

The taking-off means may comprise rotary toner delivery means for delivering toner housed inside of the toner cartridge main body, toward the toner falling aperture. The rotary toner delivery means may comprise a screw conveyor.

Preferably, the sealing member is a tape-like member. In such an arrangement, even though the sealing member is wound on a part of the rotary toner delivery means, no adverse effect is substantially exerted to the performance of the toner delivery means.

The present invention provides, as another aspect, a mechanism for opening/closing a toner falling aperture, applied to an image forming apparatus having: a developing unit main body removably set to a housing concave in the main body of the image forming apparatus; a toner cartridge main body slidably connected to the top surface of the developing unit main body and removably set to the housing concave or cavity; and upper and lower toner falling apertures respectively formed in the bottom of the toner cartridge main body and in the top surface of the developing unit main body, the apertures being adapted to communicate with each other: the mechanism for opening/closing a toner falling aperture comprising: an upper shutter member slidably disposed under the bottom of the toner cartridge main body for opening/closing the upper toner falling aperture; first biasing means for biasing the upper shutter member to close the upper toner falling aperture; a lower shutter member slidably disposed on the top surface of the developing unit main body for opening/closing the lower toner falling aperture; second biasing means for biasing the lower shutter member to close the lower toner falling aperture; first engaging means disposed at the lower shutter member and adapted to be engaged with an engaging portion of the main body of the image forming apparatus such that the lower shutter member opens the lower toner falling aperture when the developing unit main body is inserted into the housing concave; and second engaging means respectively disposed at the upper shutter member and the lower shutter member for engaging the upper and lower shutter members with each other.

According to the arrangement above-mentioned, when the toner cartridge main body alone is inserted into the image forming apparatus in which the developing unit main body has been set in the housing concave and in which the lower toner falling aperture has been opened, the second engaging means are engaged with each other, causing the upper shutter member to open the upper toner falling aperture. When the toner cartridge main body alone is pulled out, the second engaging means are disengaged from each other so that the first biasing means causes the upper shutter member to automatically close the upper toner falling aperture. This prevents toner from scattering.

When the toner cartridge main body and the developing unit main body are integrally inserted into the housing concave of the main body of the image forming apparatus, the engagement of the first engaging means causes the lower shutter member to open the lower toner falling aperture and the engagement of the second engaging means with each other causes the upper shutter member to open the upper toner falling aperture in association with the opening of the lower toner falling aperture. When the toner cartridge main body and the developing unit main body are integrally pulled out, the disengagement of the first engaging means causes the first and second biasing means to automatically close the upper and lower toner falling apertures.

Provision is made such that the upper and lower shutter members are interlockingly operated. This not only provides simplification of the structure and reduction in production cost, but also prevents toner from scattering due to difference in opening/closing timing between the upper and lower shutter members.

Preferably, the toner cartridge main body and the developing unit main body are relatively slidable with respect to each other by a pair of slide mechanisms including grooves and projecting members which are adapted to be engaged with each other, and the second engaging means are disposed between the bottom of the toner cartridge main body and the top surface of the developing unit main body and between the pair of slide mechanisms. If the second engaging means cross the grooves, it is difficult to seal the groove portions that the second engaging means cross. According to the present invention, however, the second engaging means do not cross the grooves and the like. It is therefore easy to seal the space between the bottom of the toner cartridge main body and the top surface of the developing unit main body.

Preferably, the mechanism for opening/closing a toner falling aperture further comprises: a first stopper disposed at a predetermined part of the housing concave for stopping, at a predetermined insertion stroke position, the toner cartridge main body which is inserted; and a second stopper disposed at a predetermined part of the housing concave for stopping, at a predetermined insertion stroke position, the developing unit main body which is inserted: and the positions where the developing unit main body and the toner cartridge main body are stopped by the respective stoppers, are different from each other such that the lower shutter member opens the lower toner falling aperture before the upper shutter member opens the upper toner falling aperture and that the upper shutter member closes the upper toner falling aperture before the lower shutter member closes the lower toner falling aperture when the developing unit main body and the toner cartridge main body connected thereto are integrally inserted in and removed from the housing concave.

According to the arrangement above-mentioned, the lower shutter member opens the lower toner falling aperture before the upper shutter member opens the upper toner falling aperture, and the upper shutter member closes the upper toner falling aperture before the lower shutter member closes the lower toner falling aperture. This securely prevents toner from scattering between the opposite surfaces of the toner cartridge main body and the developing unit main body.

DETAILED DESCRIPTION OF THE PREFERRED EMBODIMENTS

The following will discuss in detail embodiments of the present invention with reference to the attached drawings.

First Embodiment

FIGS. 1 to 4 show a first embodiment of the present invention.

Figure 3:
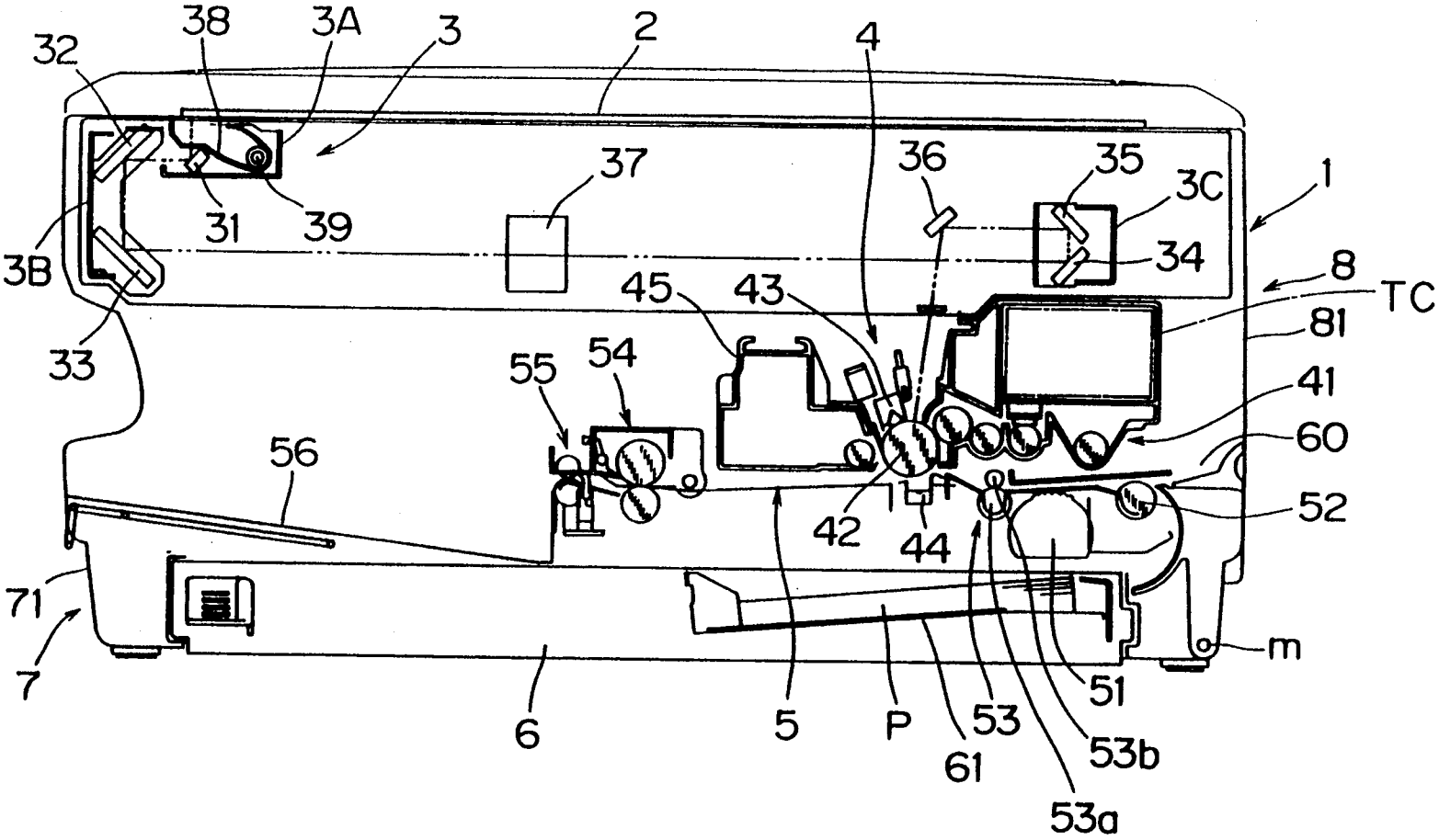
FIG. 3 is a schematic view of the inside arrangement of a copying apparatus.

Referring to FIG. 3, a copying apparatus has, inside of the main body 1 thereof, (i) an optical system 3 where a document placed on a document placing plate 2 is illuminated and scanned, and light reflected from the document is guided to a photoreceptor drum 42, (ii) an image forming unit 4 where an electrostatic latent image formed on the photoreceptor drum 42 is converted into a toner image by a developing device 41, and the toner image is then transferred onto a paper sheet, and (iii) a paper delivery unit 5 where a paper sheet is pulled out from a paper feeding tray 61 in a paper housing portion 6 by a paper feeding roller 51 having a semicircular section, and the paper sheet is passed through the image forming unit 4 and then discharged to a discharge tray 56 inside of the main body of the copying apparatus.

Figure 1:
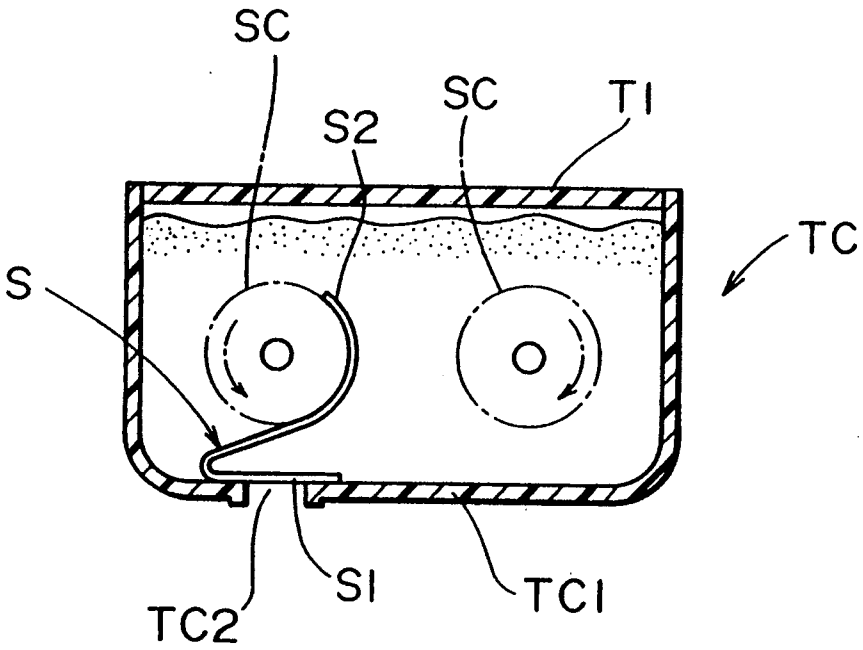
FIG. 1 is a schematic section view of a toner cartridge including a mechanism for opening/closing a toner falling aperture according to an embodiment of the present invention, the toner cartridge being not under use.
Figure 4:
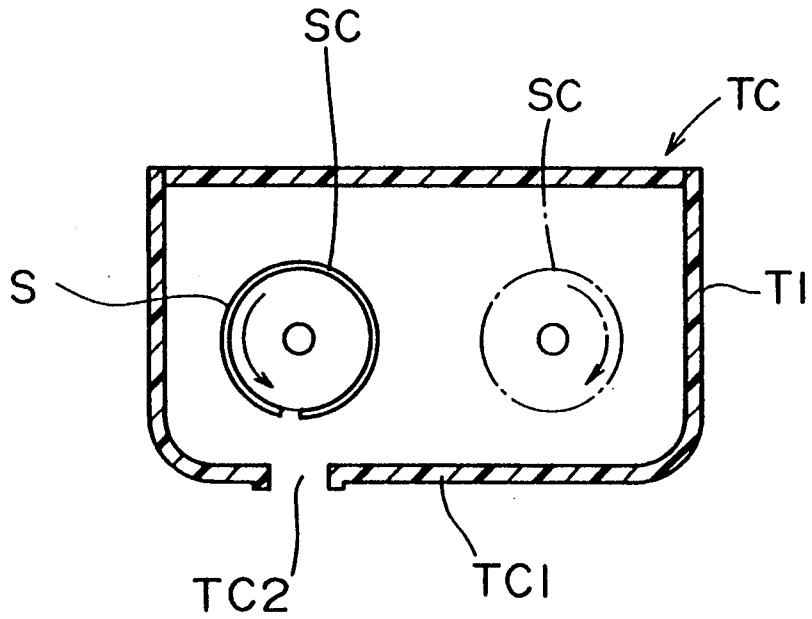
FIG. 4 is a schematic section view of the toner cartridge with a sealing member thereof taken up.

With reference to FIG. 1, removably mounted on the main body 1 of the copying apparatus is a toner cartridge TC for supplying toner to the developing device 41. A mechanism for opening/closing a toner falling aperture according to an embodiment of the present invention, is characterized in that a sealing member S which closes a toner falling aperture TC2 in the toner cartridge TC, is adapted to be taken up by a screw conveyor SC, serving as rotary delivery means, disposed inside of the toner cartridge TC, as shown in FIG. 4.

Referring to FIG. 3, the copying apparatus main body 1 has a lower unit 7 partitioned by a lower casing 71, and an lapper unit 8 partitioned by an upper casing 81 supported in a manner rotatable around a predetermined axis of rotation m at the lower end thereof, the upper unit 8 being relatively rotatable with respect to the lower unit 7. The copying apparatus main body 1 is of a so-called clamshell type in which the upper unit 8 is rotatably opened/closed with respect to the lower unit 7.

The optical system 3 is arranged such that a document is illuminated by a fluorescent lamp 39 having a reflector plate 38 secured to a first moving frame 3A, and light reflected from the document is guided to the photoreceptor drum 42 after successively passing through a first mirror 31 secured to the first moving frame 3A, second and third mirrors 32, 33 secured to a second moving frame 3B, a lens 37, fourth and fifth mirrors 34, 35 secured to a third moving frame 3C, and a sixth mirror 36.

In the image forming unit 4, there are successively disposed, around the photoreceptor drum 42, a corona discharger 43, the developing device 41, a transferring corona discharger 44 and a cleaning device 45 in this order. The image forming unit 4 is arranged such that a document image is formed to form an electrostatic latent image on the outer peripheral surface of the photoreceptor drum 42 uniformly electrically charged by the corona discharger 43, the electrostatic latent image is converted into a toner image by the developing device 41, the toner image is transferred to paper by the transferring corona discharger 44, and residual toner is collected by the cleaning device 45.

The paper delivery unit 5 comprises: the paper feeding roller 51 adapted to pull out paper, one by one, from the paper feeding tray 61; a delivery roller 52 for delivering paper from a manual paper feeding part 60 or the paper feeding tray 61; resist means 53 with which the tip of paper delivered by the delivery roller 52 comes in contact, causing the paper to temporarily wait, the resist means 53 being formed by driving roller means 53*a* and driven roller means 53*b*; a fixing unit 54 for fixing a toner image transferred onto paper; and a pair of discharging roller means 55.

Figure 2:
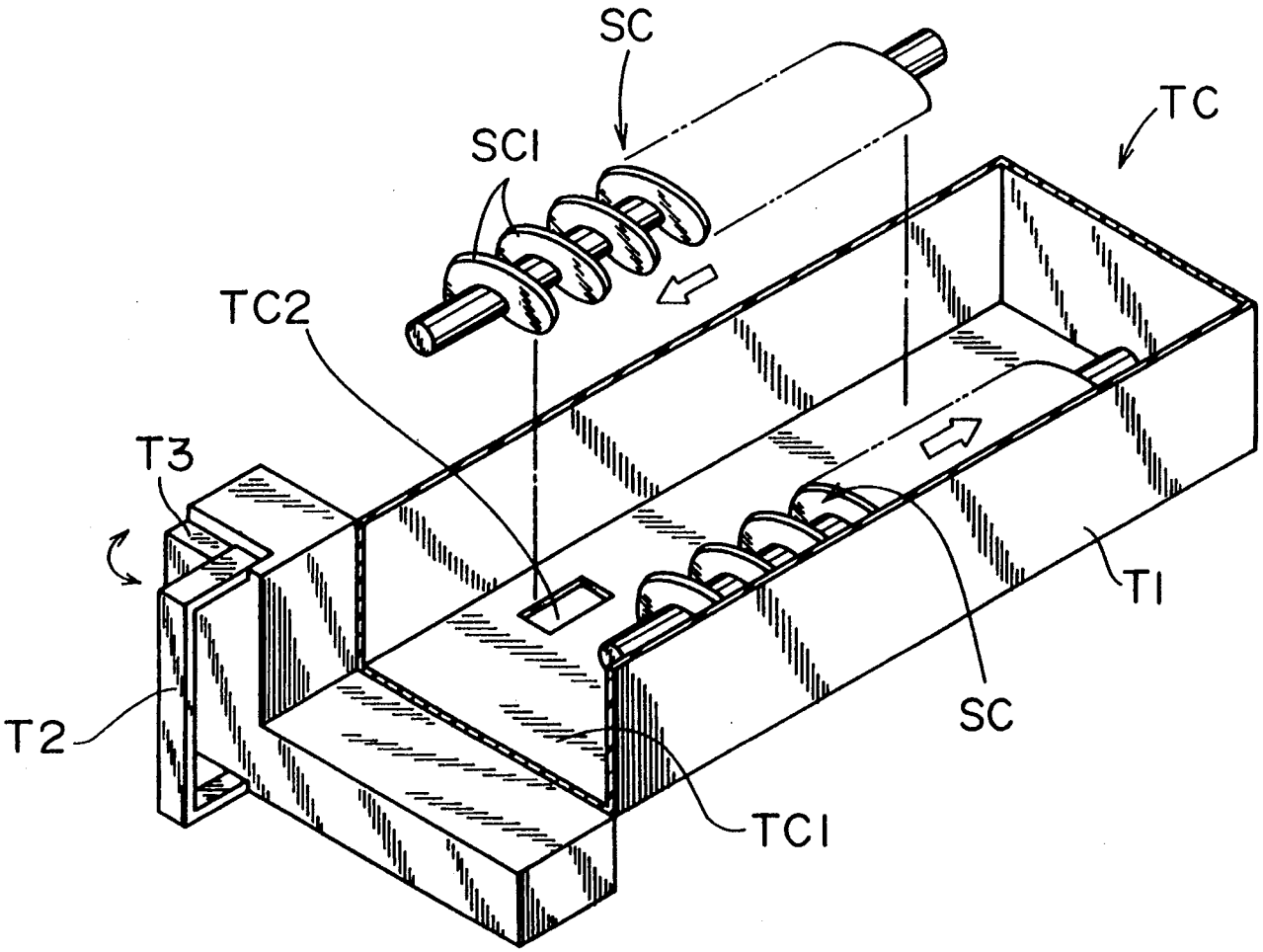
FIG. 2 is an exploded perspective view of portions of the toner cartridge shown in FIG. 1.

Referring to FIGS. 1 and 2, the toner cartridge TC comprises: a container-like toner cartridge main body T1; an aperture TC2 which is formed in the tom TC1 of the toner cartridge main body T1 and through which toner is adapted to fall toward the developing device 41; a pair of screw conveyors SC disposed inside of the toner cartridge main body T1 in the longitudinal direction thereof; and the tape-like narrow sealing member S having one end S1 which closes the aperture TC2 at the inside of the toner cartridge main body T1 while the toner cartridge TC is not under use. The other end S2 of the sealing member S is secured to a spiral blade SC1 of one screw conveyor SC. The sealing member S is stuck to the edge of the aperture TC2 by heat fusion or the like.

The screw conveyors SC are adapted to be rotated in opposite directions (See arrows shown by chain lines in FIG. 1) to feed toner in opposite direcitons (See white arrows in FIG. 2). This causes toner to be circulated while passing on the aperture TC2 inside of the toner cartridge main body T1.

The toner cartridge main body T1 is provided at the pulling-side end thereof with a channel-like movable grip T2. The grip T2 can be housed in a recess portion T3 formed at the pulling-side end such that the grip T2 does not project from the pulling-side end when the grip T2 is not under use.

According to the embodiment above-mentioned, when the toner cartridge TC which has not been used yet, is mounted on the copying apparatus main body 1 and the screw conveyors SC are rotatingly driven, the sealing member S is taken up by one of the screw conveyors SC under rotation. This causes the sealing member S to be torn off from the aperture TC2, thus opening the aperture TC2 (See FIG. 4). The sealing member S to which toner is stuck, is taken up inside of the toner cartridge main body T1. This prevents toner from scattering outside of the toner cartridge TC when the toner cartridge TC is replaced. Accordingly, no toner scatters inside and outside of the copying apparatus main body 1 when the toner cartridge TC is replaced.

The sealing member S is in the form of a narrow tape. Accordingly, even though the sealing member S is wound on a portion of the screw conveyor SC, no adverse effect is substantially exerted on the delivery performance of the screw conveyor SC.

Second Embodiment

Figure 5:
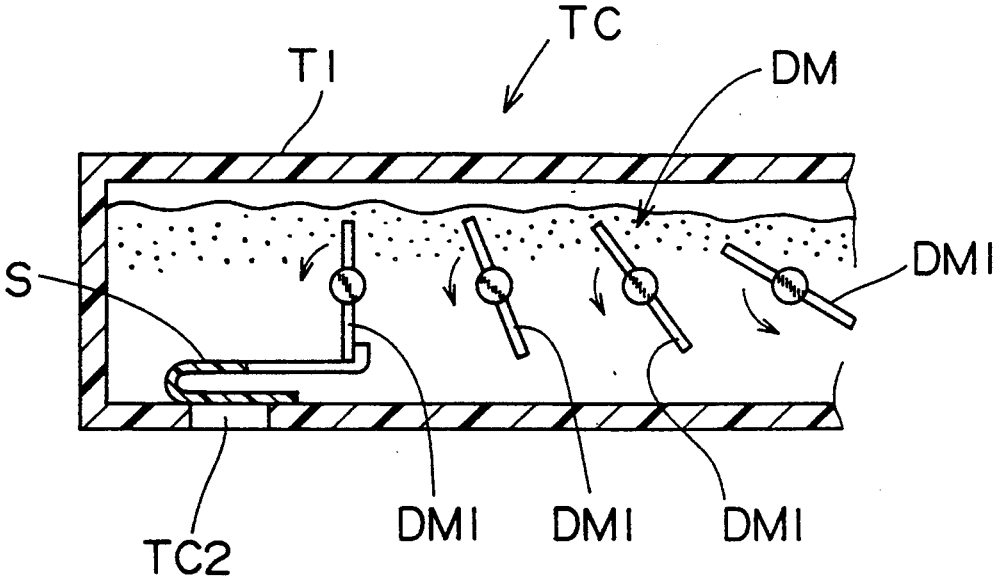
FIG. 5 is a schematic section view of a toner cartridge to which applied is a mechanism for opening/closing a toner falling aperture according to another embodiment of the present invention.

Instead of the screw conveyors used in the embodiment in FIG. 1, there may be used a toner stirring and delivery mechanism DM as shown in FIG. 5. In the toner stirring and delivery mechanism DM, a plurality of rotary plate-like stirring blades DM1 and the like are disposed in the toner delivery direction so that toner is stirred and delivered. In such an arrangement, too, a sealing member S can be taken up by one of the stirring blades DM1, and similar effects to those produced in the embodiment in FIG. 1, can be produced.

Third Embodiment

With reference to FIG. 6A to FIG. 15C, the following will discuss a further embodiment of the present invention.

Figure 7:
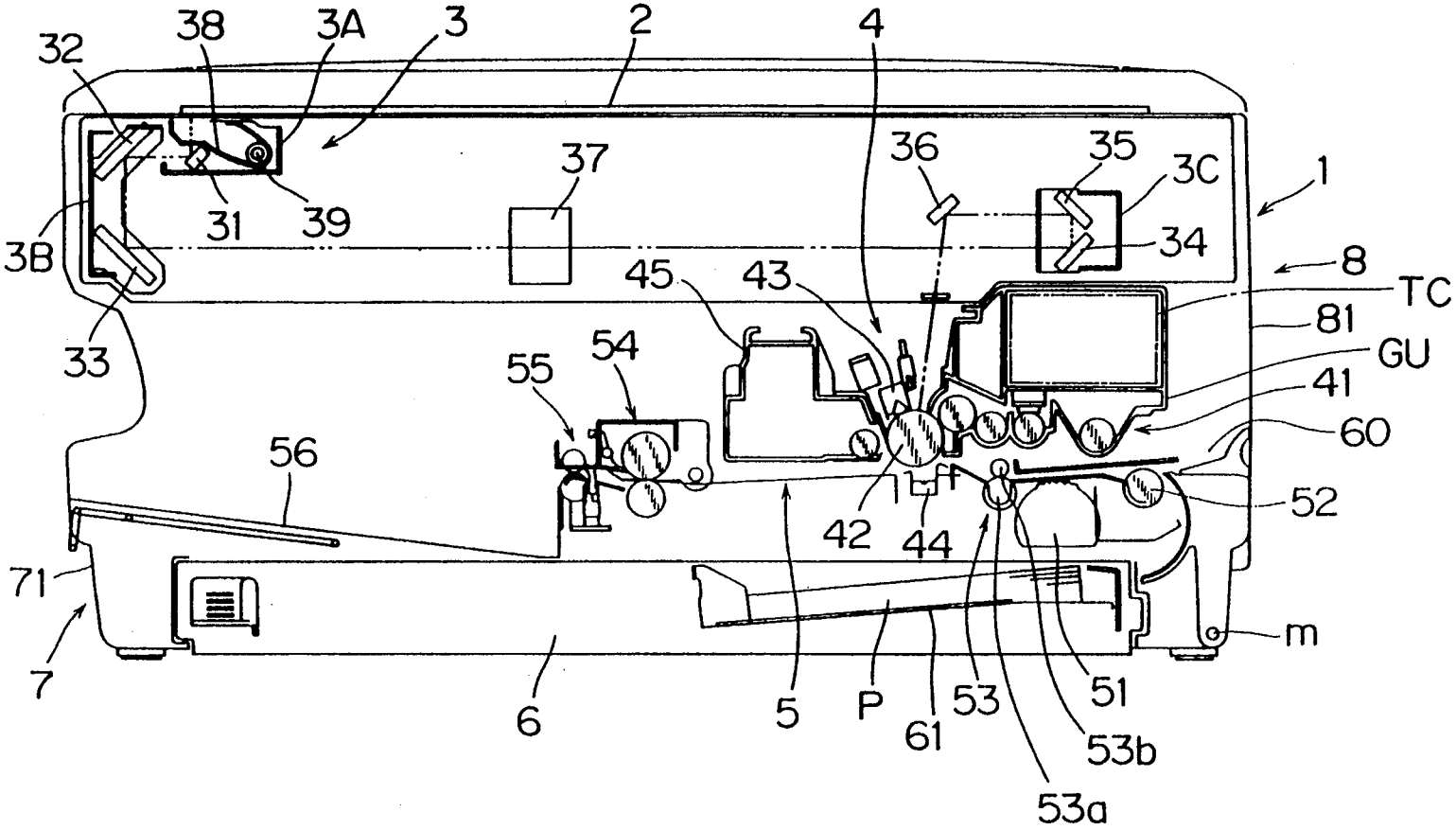
FIG. 7 is a schematic view of the inside arrangement of a copying apparatus including the mechanism for opening/closing a toner falling aperture according to the present invention.

Referring to FIG. 7, a developing device 41 is arranged in the form of an integral developing unit GU, and toner is to be supplied by a replaceable toner cartridge TC. Other component elements in FIG. 7 are similar to those shown in FIG. 3. Thus, like parts in FIG. 7 are designated by like reference numerals used in FIG. 3, and the description thereof is here omitted.

Figure 6A:
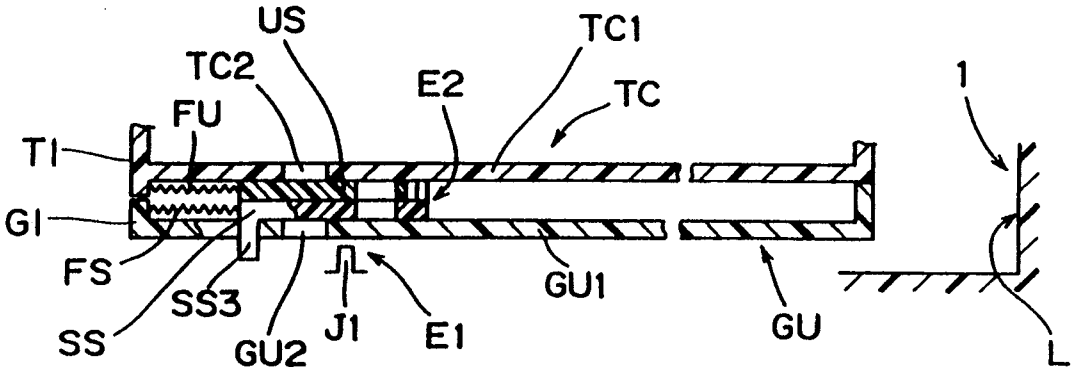
FIGS. 6A, 6B, 6C are schematic section views of a mechanism for opening/closing a toner falling aperture according to a further embodiment of the present invention, illustrating the successive steps at which the toner cartridge and the developing unit are integrally inserted.
Figure 6B:
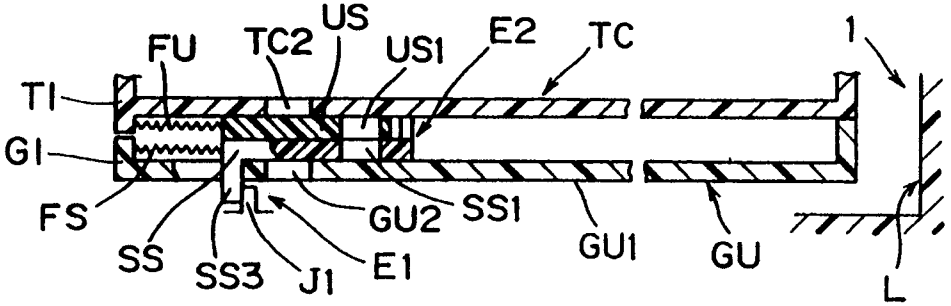
Figure 6C:
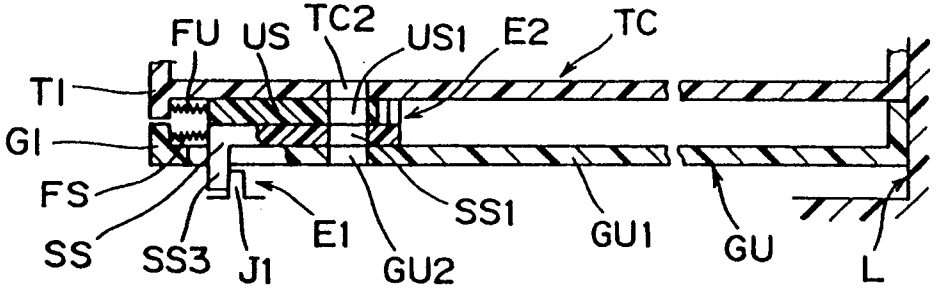
Figure 8:
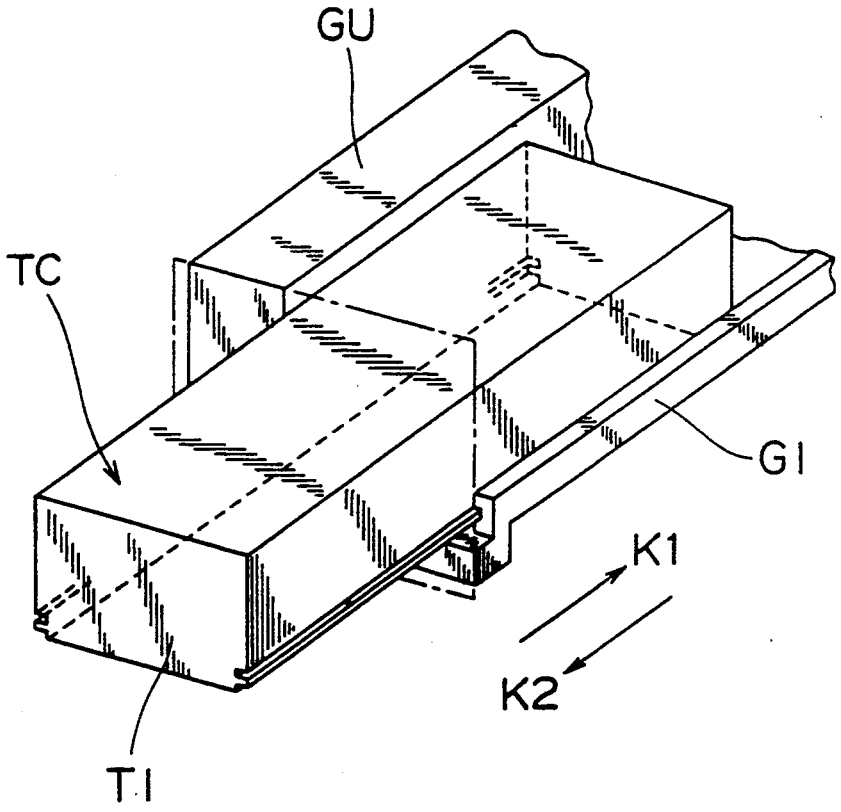
FIG. 8 is a schematic perspective view of the toner cartridge and the developing unit.
Figure 9:
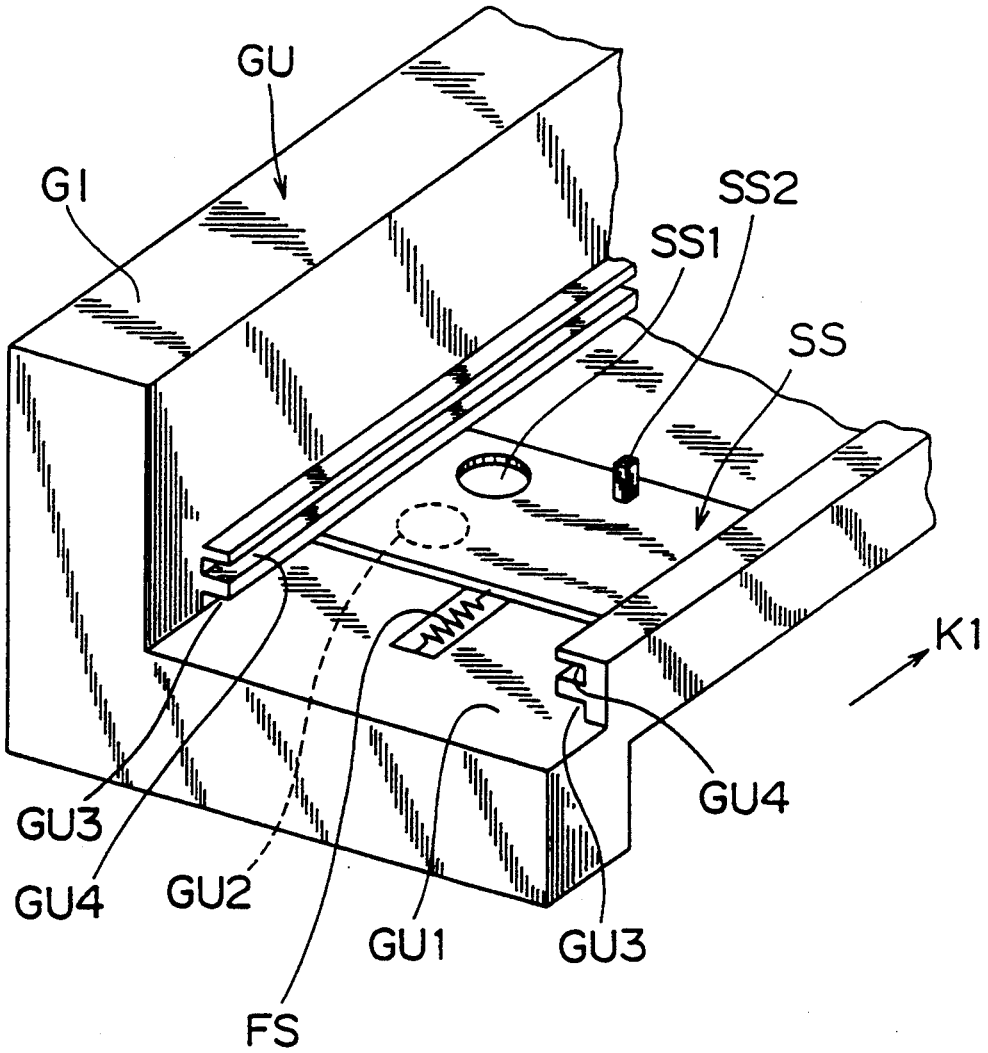
FIG. 9 is a perspective view of the main portion of the developing unit.

With reference to FIG. 8, a copying apparatus is arranged such that the developing unit GU and the toner cartridge TC are integrally or individually inserted in and removed from a predetermined part of the copying apparatus main body 1 (the inserting direction is shown by K1, while the removing direction is shown by K2). As shown in FIGS. 6A, 6B, 6C, an upper shutter member US and a lower shutter member SS are disposed for opening/closing a toner falling aperture TC2 of the toner cartridge TC and a toner falling aperture GU2 of the developing unit GU, respectively, and are adapted to be interlockingly operated. When inserted, the developing unit GU and the toner cartridge TC are stopped when the insertion-side ends thereof come in contact with a stopper L (See FIG. 6C) at a predetermined insertion stroke position.

Referring to FIGS. 6A, 6B, 6C, FIG. 9, FIG. 10 and FIG. 11, the developing unit main body G1 has guide grooves GU3 in which both lateral edges of the lower shutter member SS are inserted. This enables the lower shutter member SS to be slid on the top surface GU1 of the developing unit main body G1. Further, the developing unit main body G1 has guide grooves GU4 in which projections TC3 of the toner cartridge TC are inserted. This enables the toner cartridge TC to be slidably inserted in and removed from the developing unit GU.

Figure 10:
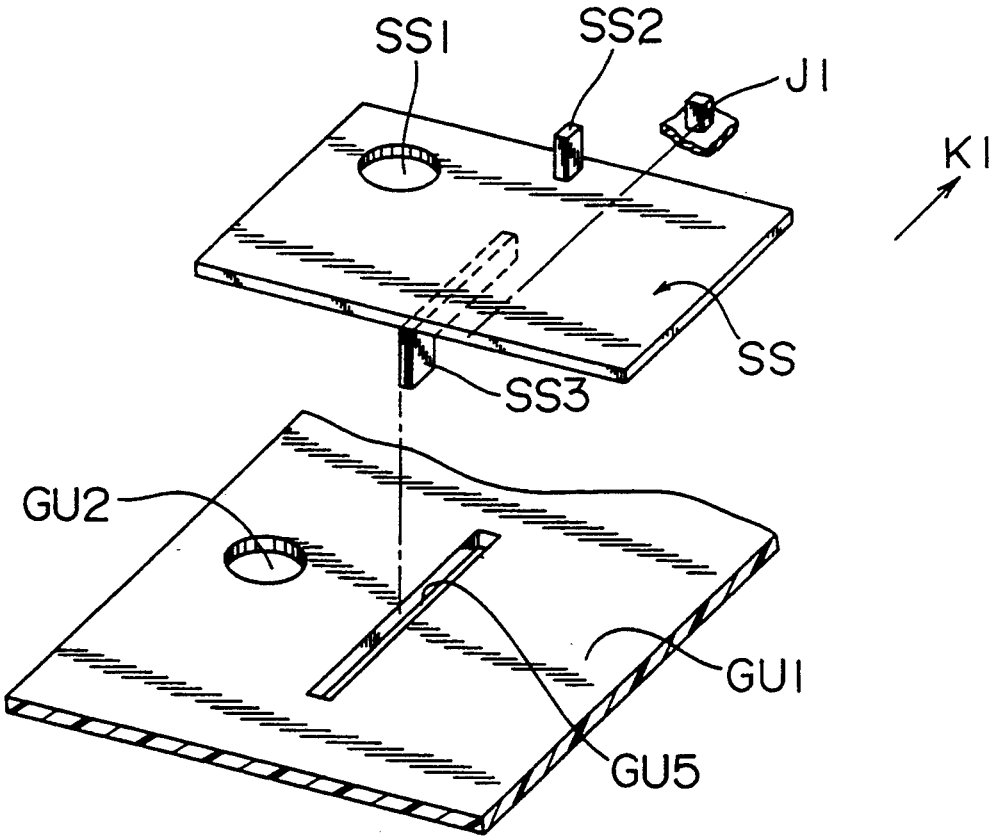
FIG. 10 is an exploded perspective view of the top surface of the developing unit and a lower shutter member.
Figure 11:
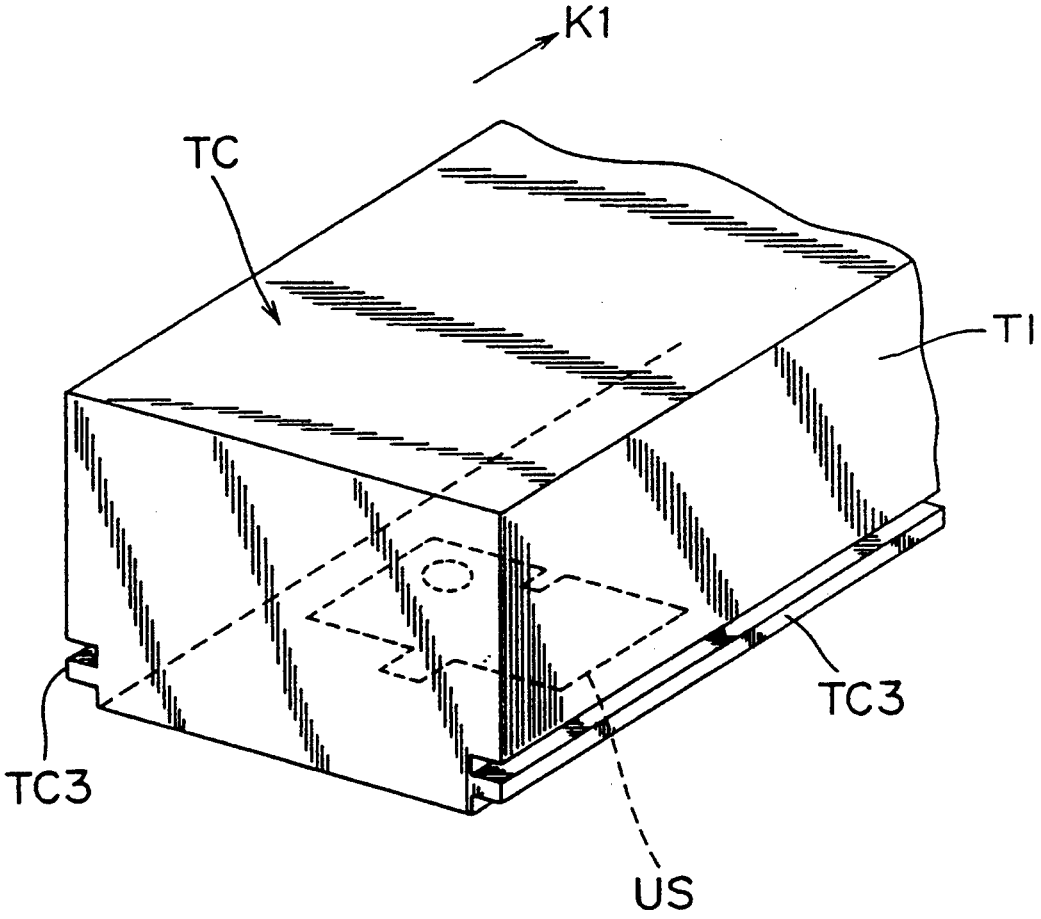
FIG. 11 is a perspective view of the main portion of the toner cartridge.
Figure 12:
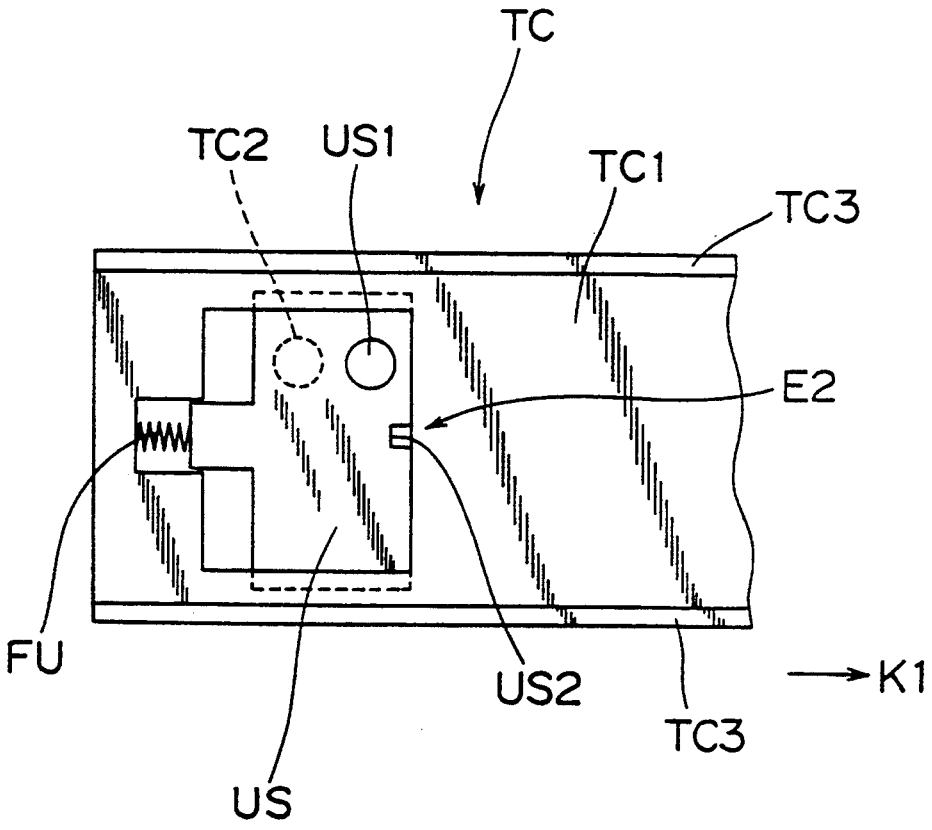
FIG. 12 is a bottom view of the toner cartridge.
Figure 13:
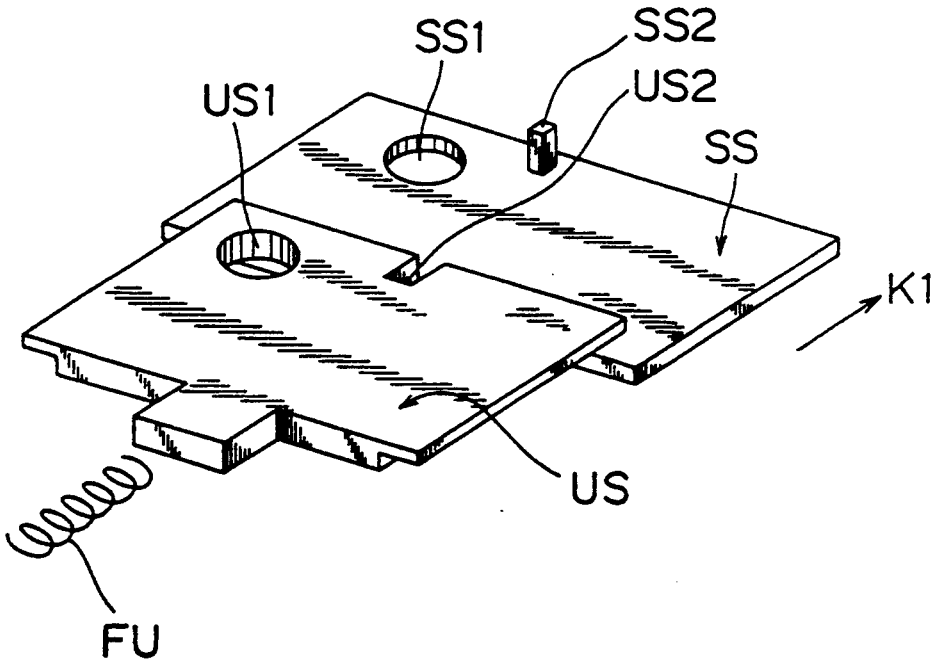
FIG. 13 is an exploded perspective view of both shutter members.
Figure 14:
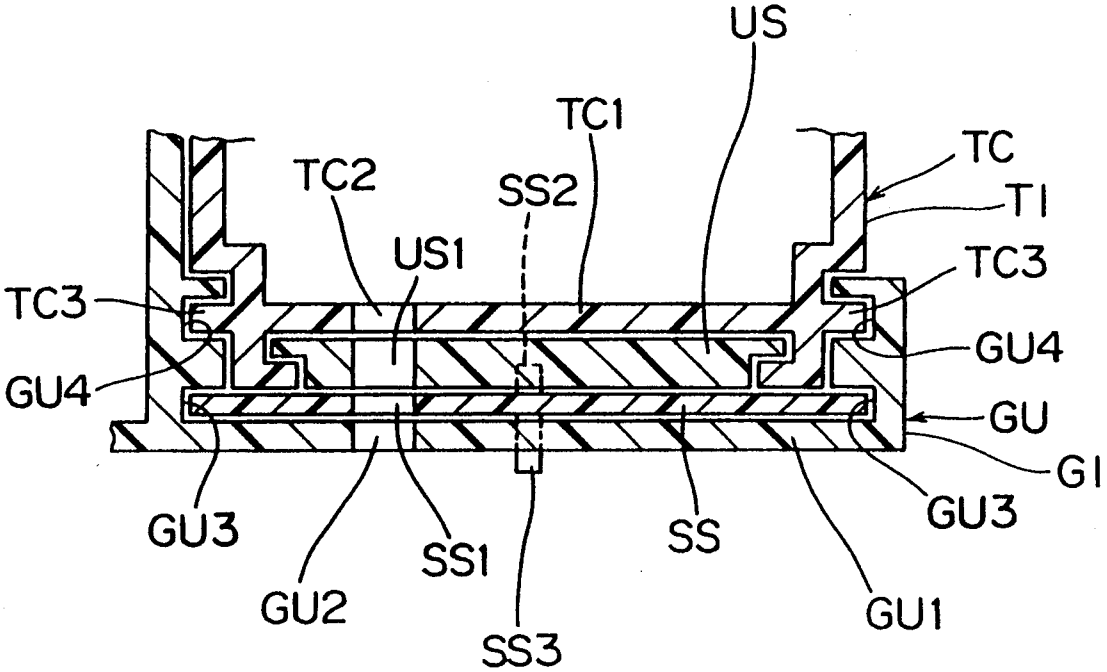
FIG. 14 is a section view of the main portions of the developing unit and the toner cartridge.

Referring to FIG. 10, the lower shutter member SS is made of a plate member and has a lower communicating aperture SS1 which is adapted to communicate with the aperture GU2 in the developing unit GU when the lower shutter member SS is slided to a predetermined position. The lower shutter member SS is provided on the top surface thereof with an upward projection SS2 engageable with a groove US2 in the upper shutter member US. The lower shutter member SS is provided at the underside thereof with a downward projection SS3, serving as first engaging means, which passes through a slit GU5 in the top surface GU1 of the developing unit GU and which is engageable with a projection J1 of the copying apparatus main body 1. By a compression coiled spring FS serving as biasing means, the lower shutter member SS is normally biased toward the inserting direction K1 such that the aperture SS1 is positionally shifted toward the inserting direction K1 with respect to the aperture GU2 in the developing unit GU. That is, the lower shutter member SS is biased to close the aperture GU2.

When the downward projection SS3 of the lower shutter member SS is engaged with the projection J1 of the copying apparatus main body 1, the lower shutter member SS opens/closes the aperture GU2 in association with the insertion and removal of the developing unit GU. The groove US2 in the upper shutter member US and the lapward projection SS2 of the lower shutter member SS form second engaging means for interlockingly operating the upper and lower shutter members US, SS.

Referring to FIGS. 11 to 14, the toner cartridge main body T1 is a box-like container. Slidably attached to the toner cartridge main body T1 is the upper shutter member US for opening/closing the toner falling aperture TC2 formed in the bottom TC1 of the toner cartridge main body T1. The upper shutter member US has an upper communicating aperture US1 which is adapted to communicate with the aperture TC2 in the toner cartridge. TC when the upper shutter member US is slided to a predetermined position. Also, the upper shutter member US has the groove US2 engageble with the upward projection SS2 of the lower shutter member SS when the upper shutter member US is slided to a predetermined position. By a compression coiled spring FU serving as biasing means, the upper shutter member US is normally biased toward the inserting direction K1 such that the aperture US1 is positionally shifted toward the inserting direction K1 with respect to the aperture TC2 in the toner cartridge TC. That is, the upper shutter member US is biased to close the aperture TC2.

The following will discuss the operation of the mechanism for opening/closing a toner falling aperture.

Figure 15A:
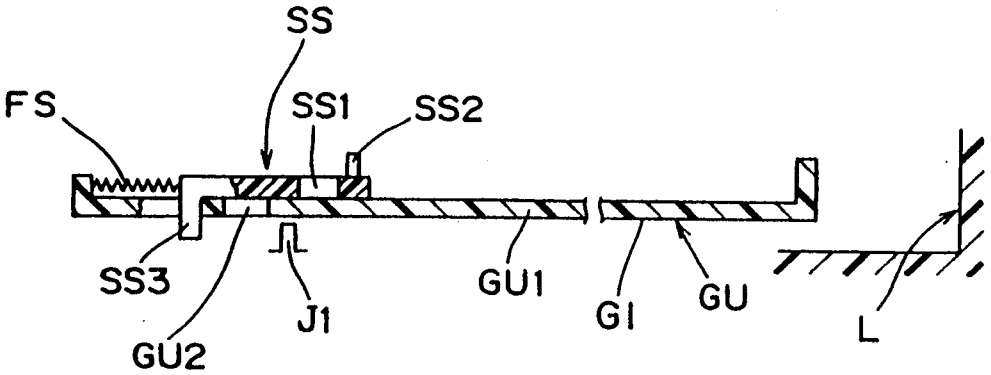
FIGS. 15A, 15B, 15C are schematic section views illustrating in succession the operations in which the developing unit is inserted.
Figure 15B:
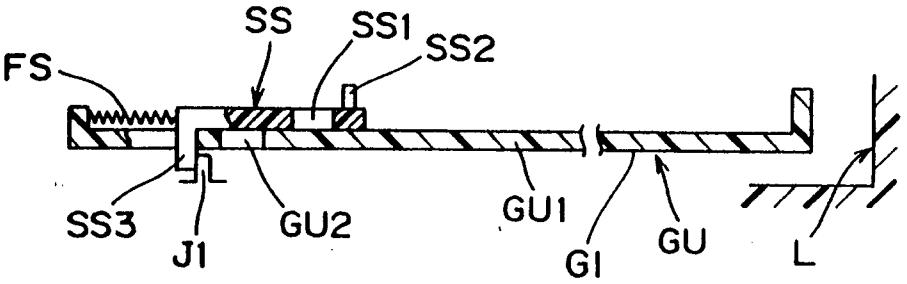
Figure 15C:
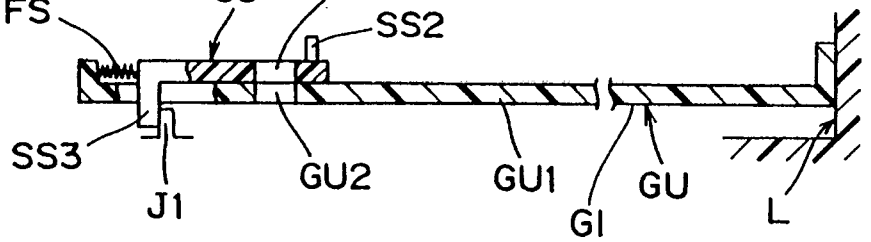

First, with reference to FIGS. 15A, 15B, 15C, the description will be made of the case where only the developing unit GU is mounted. With the lower shutter member SS so biased as to close the aperture GU2, the developing unit GU is inserted into a predetermined part of the copying apparatus main body 1 (FIG. 15A). When the developing unit GU reaches the terminal end of an insertion stroke, the downward projection SS3 of the lower shutter member SS is engaged with the projection J1 of the copying apparatus main body 1 (FIG. 15B). This restrains the lower shutter member SS from being relatively moved with respect to the copying apparatus main body 1. When the developing unit GU is further inserted, the compression coiled spring FS is contracted and the developing unit GU is relatively moved with respect to the lower shutter member SS, so that the aperture GU2 in the developing unit GU is opened. At the same time, the developing unit GU is stopped as coming in contact with the stopper L (FIG. 15C). When removing the developing unit GU, the operations above-mentioned may be reversed. That is, the developing unit GU may be removed with the aperture GU2 closed by the lower shutter member SS.

With reference to FIGS. 6A, 6B, 6C, the following description will discuss the case where the developing unit GU and the toner cartridge TC connected thereto are integrally inserted. With the developing unit GU connected to the toner cartridge TC, the groove US2 in the upper shutter member US is engaged with the upward projection SS2 of the lower shutter member SS, and the apertures US1, SS1 in the both upper and lower shutter members US, SS communicate with each other.

When the developing unit GU and the toner cartridge TC are inserted (FIG. 6A) and reach the terminal end of the insertion stroke, the downward projection SS3 of the lower shutter member SS is engaed with the projection J1 of the copying apparatus main body 1 (FIG. 6B). This restrains the upper and lower shutter members US, SS from being relatively moved with respect to the copying apparatus main body 1. When the developing unit GU and the toner cartridge TC are further inserted, the compression coiled springs FU, FS are contracted, and the developing unit GU and the toner cartridge TC are relatively moved with respect to the shutter members US, SS. Accordingly, the apertures GU2, TC2 in the developing unit GU and the toner cartridge TC are opened. At the same time, the developing unit GU and the toner cartridge TC are stopped as coming in contact with the s topper L (FIG. 6C). When removing the developing unit GU and the toner cartridge TC, the operations above-mentioned may be reversed. That is, the developing unit GU and the toner cartridge TC may be removed with the apertures TC2, GU2 closed by the shutter members US, SS.

In this embodiment, the upper and lower shutter members US, SS for the toner cartridge TC and the developing unit GU are so biased as to close the apertures TC2, GU2. Accordingly, even though the toner cartridge TC alone or the developing unit GU alone is removed, no toner falls through the aperture TC2 or GU2.

Provision is made such that the shutter members US, SS for the toner cartridge TC and the developing unit GU are interlockingly operated. This not only simplifies the structure to lower the production cost, but also prevents toner from scattering due to an undesired difference in opening/closing timing between the shutter members US, SS.

The upward projection SS2 and the groove US2 serving as engaging means for interlockingly operating the shutter members US, SS, are disposed between the bottom TC1 of the toner cartridge main body T1 and the top surface GU1 of the developing unit main body G1 and between the pair of guide grooves GU4. It is now supposed that the upward projection SS2 crosses the guide grooves GU4. In such a case, it is required to provide a space in which the upward projection SS2 is relatively moved with respect to the guide grooves GU4. It is difficult to seal such a space. According to the third embodiment, however, it is easy to seal the space between the bottom TC1 of the toner cartridge main body T1 and the top surface GU1 of the developing unit main body G1.

Fourth Embodiment

Figure 16A:
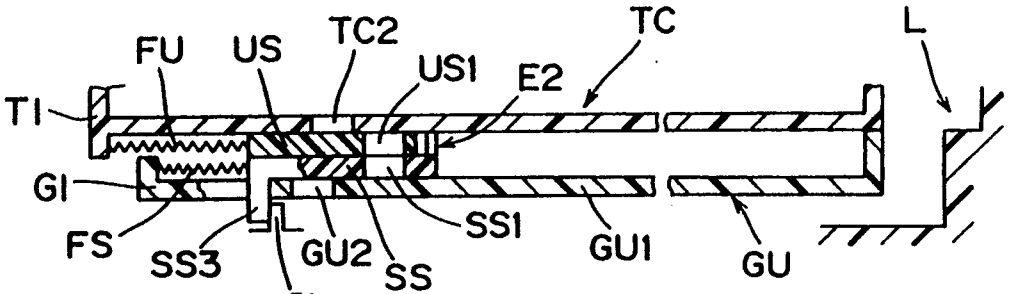
FIGS. 16A, 16B, 16C are schematic section views illustrating the successive operations of a mechanism for opening/closing a toner falling aperture according to still another embodiment of the present invention.
Figure 16B:
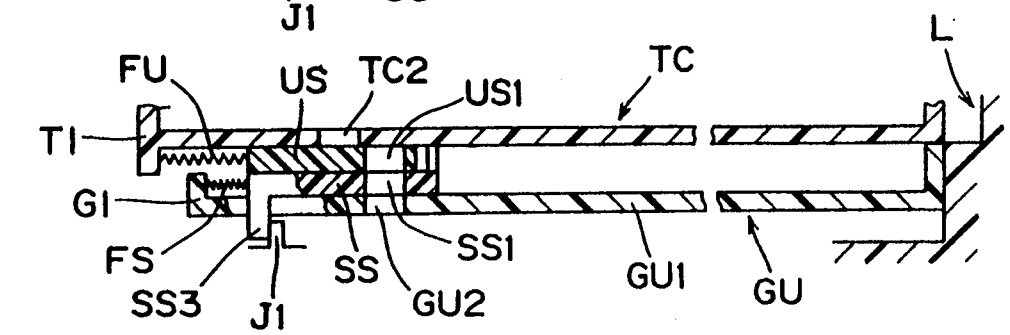
Figure 16C:
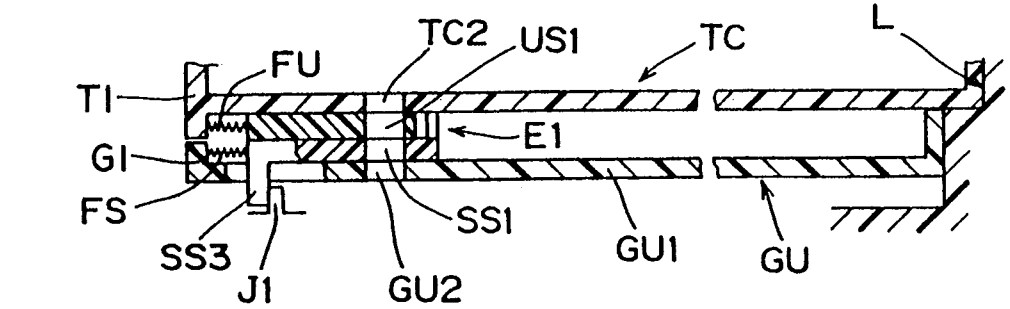

FIGS. 16A, 16B, 16C show a fourth embodiment of the present invention. The fourth embodiment differs from the third embodiment in FIGS. 6A, 6B, 6C in the following two points.

(i) Provision is made such that the toner cartridge TC and the developing unit GU are integrally inserted and removed as connected to each other by a predetermined holding force (See FIG. 16A).

(ii) The stopper L has a stepped structure such that the developing unit GU and the toner cartridge TC are adapted to be stopped at different insertion stroke stop positions. Accordingly, the lower shutter member SS opens the aperture GU2 (See FIG. 16B) before the upper shutter member US opens the aperture TC2 (See FIG. 16C). When removing the toner cartridge TC and the developing unit GU, the upper shutter member US closes the aperture TC2 before the lower shutter member SS closes the aperture GU2. This fourth embodiment not only produces effects similar to those produced by the embodiment shown in FIG. 6A, but also securely prevents toner from scattering in the space between the opposite surfaces of the toner cartridge and the developing unit.

It is a matter of course that the present invention is not limited to the embodiments above-mentioned, but a variety of modifications may be made without departing from the scope of the present invention.

What is claimed is:

1. A mechanism for opening/closing a toner falling aperture formed in a bottom of a main body of a toner cartridge in which toner is housed, comprising:

a sealing member which is disposed inside of said toner cartridge main body and which is removably attached to a top surface of said bottom for closing said toner falling aperture; and taking-off means which is disposed inside of said toner cartridge main body, to which an end of said sealing member is secured, and which is adapted to take off said sealing member while winding the same thereon when said taking-off means is driven by an external driving source.

2. A mechanism for opening/closing a toner falling aperture according to claim 1, wherein said sealing member is a tape-like member.

3. A mechanism for opening/closing a toner falling aperture according to claim 1, wherein said taking-off means includes rotary toner delivery means for delivering toner housed inside of said toner cartridge main body, toward said toner falling aperture.

4. A mechanism for opening/closing a toner falling aperture according to claim 3, said rotary toner delivery means includes a screw conveyor.

5. A mechanism for opening/closing a toner falling aperture, applied to an image forming apparatus comprising: a developing unit main body removably set in a housing cavity in a main body of said image forming apparatus; a toner cartridge main body slidably connected to a top surface of said developing unit main body and removably set in said housing cavity; and upper and lower toner falling apertures respectively formed in a bottom of said toner cartridge main body and in the top surface of said developing unit main body, said apertures being adapted to communicate with each other, said mechanism comprising:

an upper shutter member slidably disposed under said bottom of said toner cartridge main body for opening/closing said upper toner falling aperture;

first biasing means for normally biasing said upper shutter member to close said upper toner falling aperture;

a lower shutter member slidably disposed on said top surface of said developing unit main body for opening/closing said lower toner falling aperture;

second biasing means for normally biasing said lower shutter member to close said lower toner falling aperture;

first engaging means disposed at said lower shutter member and adapted to be engaged with an engaging portion of said main body of said image forming apparatus such that said lower shutter member opens said lower toner falling aperture when said developing unit main body is inserted into said housing cavity; and second engaging means respectively disposed at said upper shutter member and said lower shutter member for engaging said upper and lower shutter members with each other.

6. A mechanism for opening/closing a toner falling aperture according to claim 5, wherein:

said upper shutter member and said lower shutter member respectively have upper and lower communicating apertures adapted to communicate with each other when said upper and lower shutter members are engaged with each other by said second engaging means;

said upper communicating aperture is adapted to communicate with said upper toner falling aperture when said upper shutter member slides with respect to said toner cartridge main body; and said lower communicating aperture is adapted to communicate with said lower toner falling aperture when said lower shutter member slides with respect to said developing unit main body.

7. A mechanism for opening/closing a toner falling aperture according to claim 5, wherein said first engaging means includes a projection formed at an underside of said lower shutter member.

8. A mechanism for opening/closing a toner falling aperture according to claim 5, wherein:

said toner cartridge main body and said developing unit main body are relatively slidable with respect to each other by a pair of slide mechanisms including grooves and projecting members which are engaged with each other; and said second engaging means are disposed between said bottom of said toner cartridge main body and said top surface of said developing unit main body and between said pair of slide mechanisms.

9. A mechanism for opening/closing a toner falling aperture according to claim 5, wherein one of said second engaging means includes a projection, and the other of said second engaging means includes a groove into and from which said projection is adapted to be inserted and come out.

10. A mechanism for opening/closing a toner falling aperture according to claim 5, wherein said first biasing means includes a compression coiled spring for normally biasing said upper shutter member in a direction in which said toner cartridge main body is inserted.

11. A mechanism for opening/closing a toner falling aperture according to claim 5, wherein said second biasing means includes a compression coiled spring for normally biasing said lower unit shutter member in a direction in which said developing unit main body is inserted.

12. A mechanism for opening/closing a toner falling aperture according to claim 5, further comprising:

a first stopper disposed at a predetermined part of said housing cavity for stopping, at a predetermined insertion stroke position, said toner cartridge main body which is inserted; and a second stopper disposed at a predetermined part of said housing cavity for stopping, at a predetermined insertion stroke position, said developing unit main body which is inserted, the positions where said toner cartridge main body and said developing unit main body are respectively stopped by said first and second stoppers, being different from each other such that said lower shutter member opens said lower toner falling aperture before said upper shutter member opens said upper toner falling aperture and that said upper shutter member closes said upper toner falling aperture before said lower shutter member closes said lower toner falling aperture when said developing unit main body and said toner cartridge main body connected thereto are integrally inserted in and removed from said housing cavity.

13. A mechanism as recited in claim 1 wherein said sealing member is an elastic strip of material.

14. A mechanism as recited in claim 1 wherein said sealing member is a tape-like member which, prior to removal, is joined to said top surface by a heat fusion bond.

* * * * *